US010023437B2

(12) United States Patent
Kuppelwieser et al.

(10) Patent No.: US 10,023,437 B2
(45) Date of Patent: Jul. 17, 2018

(54) DOOR SYSTEM FOR AN ELEVATOR INSTALLATION

(71) Applicant: INVENTIO AG, Hergiswil (CH)

(72) Inventors: Ralph Kuppelwieser, Pratteln (CH); Ernst Lüthi, Brittnau (CH); Jonas Vonaesch, Lucerne (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/520,878

(22) PCT Filed: Oct. 23, 2015

(86) PCT No.: PCT/EP2015/074561
§ 371 (c)(1),
(2) Date: Apr. 21, 2017

(87) PCT Pub. No.: WO2016/062842
PCT Pub. Date: Apr. 28, 2016

(65) Prior Publication Data

US 2017/0334680 A1 Nov. 23, 2017

(30) Foreign Application Priority Data

Oct. 23, 2014 (EP) ..... 14190021

(51) Int. Cl.
*B66B 13/06* (2006.01)
*B66B 13/16* (2006.01)
(Continued)

(52) U.S. Cl.
CPC ..... *B66B 13/06* (2013.01); *B66B 13/16* (2013.01); *B66B 3/00* (2013.01); *B66B 5/00* (2013.01); *B66B 13/00* (2013.01)

(58) Field of Classification Search
CPC combination set(s) only.
See application file for complete search history.

(56) References Cited

U.S. PATENT DOCUMENTS 2,175,323 A * 3/1937 Shepard
3,277,951 A * 10/1966 Levicke ..... E06B 3/482 160/185
(Continued)

FOREIGN PATENT DOCUMENTS

GB 2447891 A 1/2008
JP H10316334 A 12/1998
(Continued)

*Primary Examiner* — Michael A Riegelman
(74) *Attorney, Agent, or Firm* — William J. Clemens; Shumaker, Loop & Kendrick, LLP

(57) ABSTRACT

A door system for an elevator installation having an elevator car, the door system including a pivotable first car door leaf mounted at a car door opening and a pivotable first shaft door leaf mounted at a shaft door opening of the elevator installation. At least a part of the shaft door opening is closed by the first shaft door leaf in a closed position thereof and a shaft door plane is formed along the shaft door leaf. At least a part of the car door opening is closed by the first car door leaf in a closed position thereof and a car door plane is formed along the car door leaf. The car door leaf, in an open position thereof, extends through the shaft door plane, or the shaft door leaf, in an open position thereof, extends through the car door plane.

8 Claims, 2 Drawing Sheets

(51) Int. Cl.

| | |
|---|---|
| *B66B 3/00* | (2006.01) |
| *B66B 5/00* | (2006.01) |
| *B66B 13/00* | (2006.01) |

(56) References Cited

U.S. PATENT DOCUMENTS

| | | | | | |
|---|---|---|---|---|---|
| 3,348,628 | A * | 10/1967 | Dixon | E06B 3/94 | 160/40 |
| 4,027,714 | A * | 6/1977 | Dixon et al. | | |
| 4,867,221 | A * | 9/1989 | Dixon et al. | | |
| 6,615,894 | B1 * | 9/2003 | McKeon | | |
| 7,845,386 | B2 * | 12/2010 | Coleman | E05D 15/0652 | 160/199 |
| 2012/0031002 | A1 * | 2/2012 | Bell | E05D 15/063 | 49/70 |

FOREIGN PATENT DOCUMENTS

| | | | | |
|---|---|---|---|---|
| JP | 2006232456 | A | * | 9/2006 |
| WO | 2009/050327 | A1 | | 4/2009 |

* cited by examiner

DOOR SYSTEM FOR AN ELEVATOR INSTALLATION

FIELD

The invention relates to a door system for an elevator installation and to an elevator installation comprising such a door system.

BACKGROUND

Elevator installations are typically arranged in an elevator shaft, which connects a plurality of floors. At the height of the individual floors, the elevator shaft has shaft door openings. Shaft doors are arranged at these shaft door openings. The elevator installation comprises an elevator car, which is arranged so as to be movable within the elevator shaft. The elevator car has a car door opening. A car door is arranged at this car door opening. The shaft doors as well as the at least one car door typically each have at least one door leaf.

WO2009/050327A1 shows an elevator door system, which is embodied as folding door system. The door system comprises a shaft and a car door. The shaft door comprises a plurality of shaft door leaves. The car door comprises a same number of car door leaves. In the open position of the folding door system, the car door leaves are folded on the car side and the shaft door leaves are folded on the floor side. In the open position of the folding door system on the floor side as well as on the car side, this leads to a large space requirement.

SUMMARY

It is thus the object of the invention to propose a door system for an elevator installation, which has a small space requirement.

The object is solved by means of a door system for an elevator installation, which comprises an elevator car, the door system comprising a pivotable first car door leaf and a pivotable first shaft door leaf, wherein the first car door leaf can be mounted at a car door opening of the elevator car, and the first shaft door leaf can be mounted at a shaft door opening of the elevator installation, wherein at least a part of the shaft door opening can be closed by the first shaft door leaf in the closed position thereof and a shaft door plane is formed along the shaft door leaf, which can be arranged in the closed position thereof, wherein at least a part of the car door opening can be closed by the first car door leaf in the closed position thereof and a car door plane is formed along the car door leaf, which can be arranged in the closed position thereof, wherein the car door leaf, in the open position thereof, extends through the shaft door plane, or the shaft door leaf, in the open position thereof, extends through the car door plane.

The object is also solved by means of an elevator installation comprising such a door system.

The invention is based on the knowledge that the door leaf of the car door or the door leaf of the shaft door, respectively, is only arranged in the open position thereof when the elevator car is arranged at a shaft door opening so as to be blocked in the elevator shaft. It is thus only necessary to maintain the door sill gap between the car door and one of the shaft doors while the elevator car is moved in the elevator shaft. While the elevator car moves in the elevator shaft, such a door sill gap prevents that components of the elevator car collide with components, which are fixedly arranged in the elevator shaft. When the elevator car stands still, the components of the shaft or car door, respectively, can thus extend through said gap. To obtain the desired saving of space, the shaft door leaves can thus extend through the car door plane, or the car door leaves can extend through the shaft door plane while the door system is in the open position. The shaft door plane and the car door plane are preferably arranged parallel to each other, preferably vertically. Such a door system can be formed as folding door system.

In the case of a further development of the door system, the first car door leaf can be mounted at a main pivot axis arranged at the elevator car, and the first shaft door leaf can be mounted at a further main pivot axis, wherein the main pivot axis assigned to the car door leaf is arranged in parallel to the main pivot axis assigned to the shaft door leaf. A pivoting of the shaft door leaf or of the car door leaf, respectively, makes it possible that these door leaves, in the open position thereof, do not require a significant amount of space on the side of the car door or of the shaft door opening, respectively.

A further development of the door system comprises a second car door leaf, which second car door leaf is pivotably mounted at a secondary pivot axis at the first car door leaf in such a manner that the first and the second car door leaf form a folding door, and a second shaft door leaf, wherein the second shaft door leaf is pivotably mounted at a secondary pivot axis at the first shaft door leaf in such a manner that the first and the second shaft door leaf form a folding door, wherein the secondary pivot axes are arranged in parallel to the main pivot axes. It is thus made possible that the door leaves can be formed so as to be short in horizontal direction, but can nonetheless close the entire door width of the shaft or car door, respectively.

In the case of a further development of the elevator installation, the first shaft door leaf and the first car door leaf, in the open position thereof, are arranged so as to be stacked directly next to each other, and the second shaft door leaf and the second car door leaf, in the open position thereof, are arranged so as to be stacked directly next to each other. A straight line formed in the horizontal cross section, which extends through both secondary pivot axes, can thus be arranged substantially vertically to the car door or to the shaft door plane, respectively. This provides for space savings of the door system in the open position thereof in contrast to common door systems, because the two shaft door and car door leaves are stacked inside each other. This means that subsequent door leaves, in the open position thereof, are arranged in succession along the car door or shaft door plane, respectively, according to a first embodiment alternative: the first shaft door leaf, followed by the first car door leaf, followed by the second car door leaf, followed by the second shaft door leaf or according to a second embodiment alternative, respectively: the first car door leaf, followed by the first shaft door leaf, followed by the second shaft door leaf, followed by the second car door leaf.

In the case of a further development of the door system, the second car door leaf has a bearing shaft, which bearing shaft is arranged so as to be capable of being displaced along the car door plane during an opening or closing, respectively, of the door system. As an alternative or in addition, the second shaft door leaf can have a further bearing shaft, wherein the bearing shaft, which can be assigned to the shaft door, is arranged so as to be capable of being displaced along the shaft door plane during an opening or closing, respectively, of the door system. A bearing or guiding, respectively, of these ends of the door leaves is thus made possible. A distance of the car door leaves to the shaft door leaves can furthermore be adjusted in the open position thereof.

In the case of a further development of the door system, the first and the second car door leaf, in the open position thereof, form an opening angle in the range of between 5 and 15 degrees, preferably 10 degrees. In addition or in the alternative, the first and the second shaft door leaf, in the open position thereof, can form an opening angle in the range of between 5 and 15 degrees, preferably 10 degrees. It can be ensured in this manner that the corresponding door leaves, in the open position thereof, have minimum dimensions in the open position thereof, parallel and vertically to the car door or shaft door plane, respectively. Said opening angle can be detected, when the door leaves, which are assigned to the opening angle, are viewed according to a horizontal cross section.

In the case of a further development of the door system, the pivot axes, thus the main or secondary pivot axes, respectively, are arranged substantially vertically. Such an arrangement provides for a simple design of the door system, because even though the door leaves, in the open position thereof, are arranged in the door openings, they do not make it more difficult for elevator passengers to enter or leave, respectively, the elevator car.

In the case of a further development of the door system, the first shaft door leaf, in the closed position thereof, has a horizontally oriented width parallel to the shaft door plane, and the first car door leaf, in the closed position thereof, has a horizontally oriented width parallel to the car door plane, wherein the widths, which can be assigned to the first shaft door leaf and to the first car door leaf, are largely identical.

In addition, the second shaft door leaf, in the closed position thereof, can have a horizontally oriented width parallel to the shaft door plane, and the second car door leaf, in the closed position thereof, can have a horizontally oriented width parallel to the car door plane, wherein the widths, which can be assigned to the second shaft door leaf and to the second car door leaf, are largely identical, and wherein the width, which can be assigned to the first car door leaf, is largely identical to the width, which can be assigned to the second car door leaf. A particularly space-saving folding of the door system in the open position thereof is made possible in this manner.

DESCRIPTION OF THE DRAWINGS

The invention will be explained in more detail below by means of figures.

DETAILED DESCRIPTION

Figure 1:
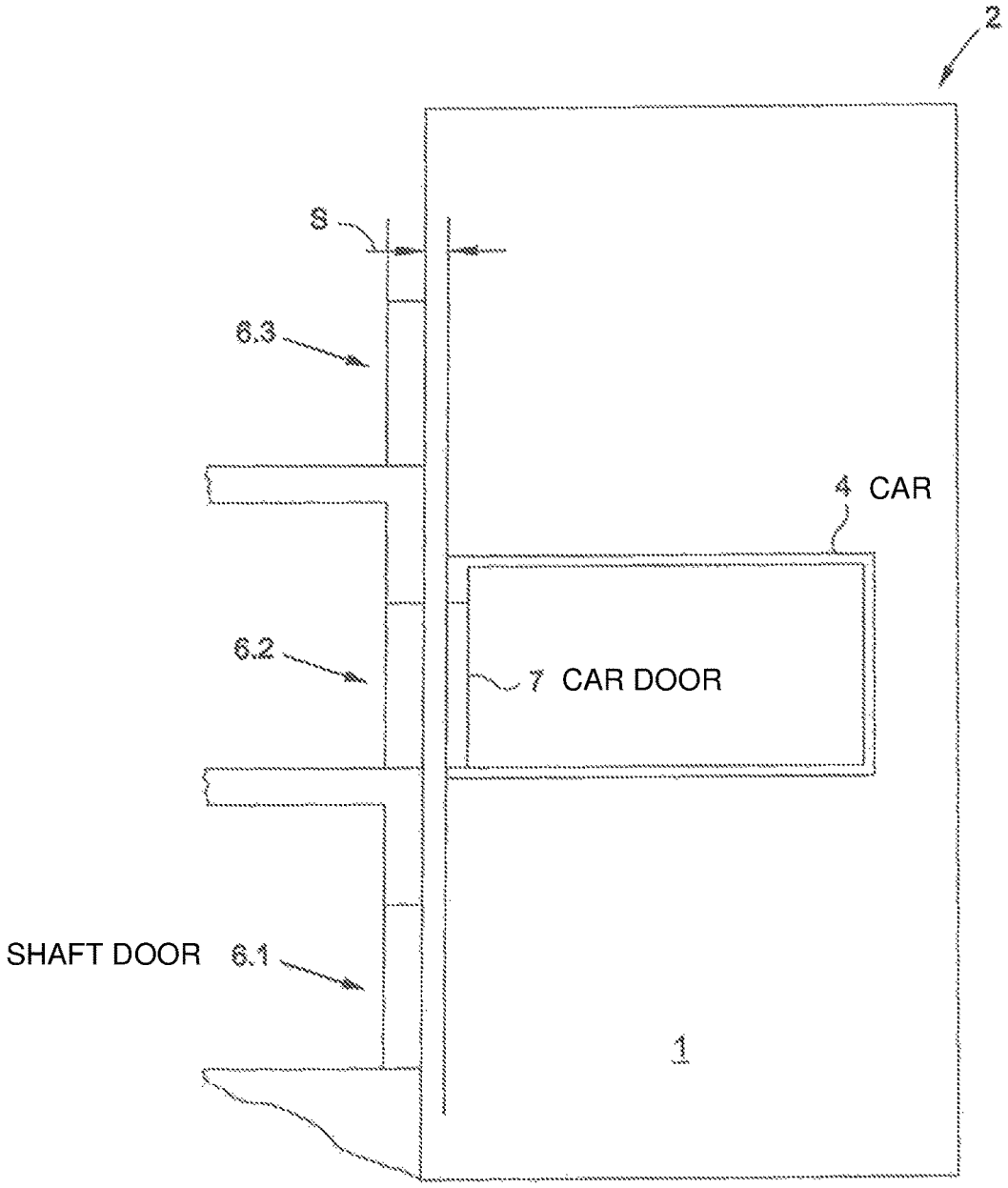
FIG. 1 shows an elevator installation comprising a door system.

FIG. 1 shows an elevator installation 2. The elevator installation 2 comprises an elevator shaft 1. The elevator shaft 1 has a plurality of shaft door openings arranged at floors. The elevator installation 2 comprises a plurality of shaft doors 6.1, 6.2, 6.3, wherein a first one of the shaft doors 6.1 is arranged at a first one of the shaft door openings and a second one of the shaft doors 6.2 is arranged at a second one of the shaft door openings. The elevator installation 2 has an elevator car 4 comprising a car door 7.

The elevator car 4 is movably arranged in the elevator shaft 1. To ensure sufficient safety while the elevator car 4 moves, the elevator car 4 is sufficiently spaced apart from the components, which are fixed in the elevator shaft 1, in particular the shaft doors 6.1, 6.2, 6.3. This distance is identified by a door sill gap S. It is prevented by means of the door sill gap S that components of the elevator car 4, for example the car door 7, touch the components fixed in the elevator shaft 1 or collide with them, respectively, while the elevator car 4 moves.

Figure 2:
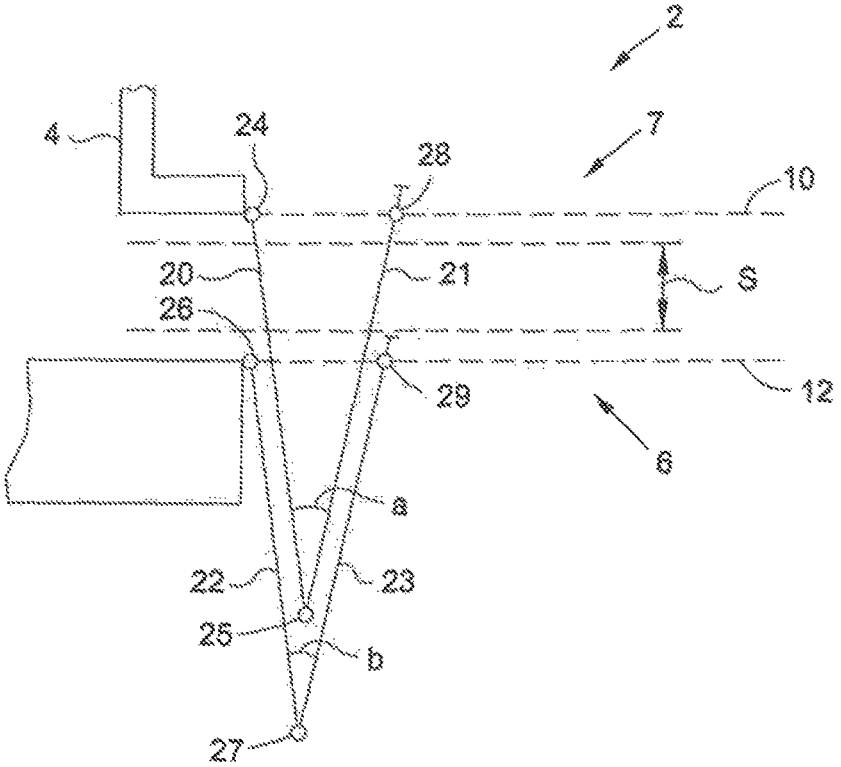
FIG. 2 shows the door system in horizontal cross section.

FIG. 2 shows a part of the elevator car 4 shown in FIG. 1, which is arranged at a floor, in a horizontal cross section. The car door 7 of the elevator car 4 comprises a first car door leaf 20 and can comprise a further car door leaf 21. The shaft door 6 arranged at the floor comprises a first shaft door leaf 22 and can comprise a further shaft door leaf 23.

The first car door leaf 20 is mounted at the elevator car 4 by means of a main pivot axis 24, which is preferably arranged vertically. The second car door leaf 21 is mounted at a secondary pivot axis 25 at the first car door leaf 20 in such a manner that the car door 7 is formed as folding door. The main and secondary pivot axis 24, 25 assigned to the car door 7 are preferably arranged in parallel. In a closed position of the car door 7, the at least one car door leaf 20, 21 is substantially arranged along a car door plane 10. This means that at least one car door leaf 20, 21, in the closed position of the car door 7, substantially forms this car door plane 10. The car door plane 10 is preferably arranged vertically in the elevator installation.

The second car door leaf 21 has a bearing shaft 28. This bearing shaft 28, which can be assigned to the car door 7, can be arranged along an end of the second car door leaf 21 or—as shown in FIG. 2—in the direct vicinity thereof. When the car door 7 is closed, this first end is formed by means of the end of the second car door leaf 21, which is spaced apart from the main pivot axis 24, which can be assigned to the car door 7. The bearing shaft 28, which can be assigned to the car door 7, can be displaced along the car door plane 10 during an opening or closing movement, respectively, of the car door 7.

The first shaft door leaf 22 is mounted at the floor side, preferably at a component of the shaft door 6, which is fixedly connected to the elevator shaft, by means of a main pivot axis 26. The main pivot axis 26, which can be assigned to the shaft door leaf 22, is preferably arranged in parallel to the main pivot axis 24, which can be assigned to the first car door leaf 20. The second shaft door leaf 23 is mounted at a secondary pivot axis 27 at the first shaft door leaf 22 in such a manner that the shaft door 6 is formed as folding door. In the closed position thereof, the at least one shaft door leaf 22, 23 is arranged along a shaft door plane 12.

The second shaft door leaf 23 has a bearing shaft 29. This bearing shaft 29, which can be assigned to the shaft door 6, can be arranged along an end of the second shaft door leaf 23 or—as shown in FIG. 2—in the direct vicinity thereof. When the shaft door 6 is closed, this end, which can be assigned to the second shaft door leaf 23, is formed by the end of the second shaft door leaf 23, which is spaced apart from the main pivot axis 26, which can be assigned to the shaft door 6. The bearing shaft 29, which can be assigned to the shaft door 6, can be displaced along the shaft door plane 12 during an opening or closing movement, respectively, of the shaft door 6.

To guide the second shaft or car door leaf 21, 23, respectively, the shaft or car door 6, 7, respectively, comprises a non-illustrated guide device. A guide shoe can in each case be arranged at the corresponding bearing shaft 28, 29 at and upper and/or lower end of the second shaft or car door leaf 21, 23, respectively. In an exemplary manner, the at least one guide shoe can in each case be guided by a guide groove, which is arranged at the upper and/or lower closure of the car or shaft door opening, respectively, along the car door or shaft door plane 10, 12, respectively.

The first and second car door leaf 20, 21, in the open position thereof, can form an opening angle a of 5-15 degrees, preferably 10 degrees. The first and the second shaft door leaf 22, 23, in the open position thereof, can form an opening angle b of 5-15 degrees, preferably 10 degrees. The door sill gap S is arranged between the car door plane 10 and the shaft door plane 12, wherein, vertically to the shaft or car door plane 10, 12, this door sill gap S can have a smaller dimension than the car door plane 10 is spaced apart from the shaft door plane 12.

According to FIG. 2, the first shaft door leaf 22 and the first car door leaf 20, in the open position thereof, are arranged so as to be stacked directly next to each other. The second shaft door leaf 23 and the second car door leaf 21, in the open position thereof, are likewise arranged so as to be stacked directly next to each other. A straight line formed in the horizontal cross section, which extends through both secondary pivot axes 25, 27, is thus arranged substantially vertically to the car door 10 or to the shaft door plane 12, respectively.

Figure 3:
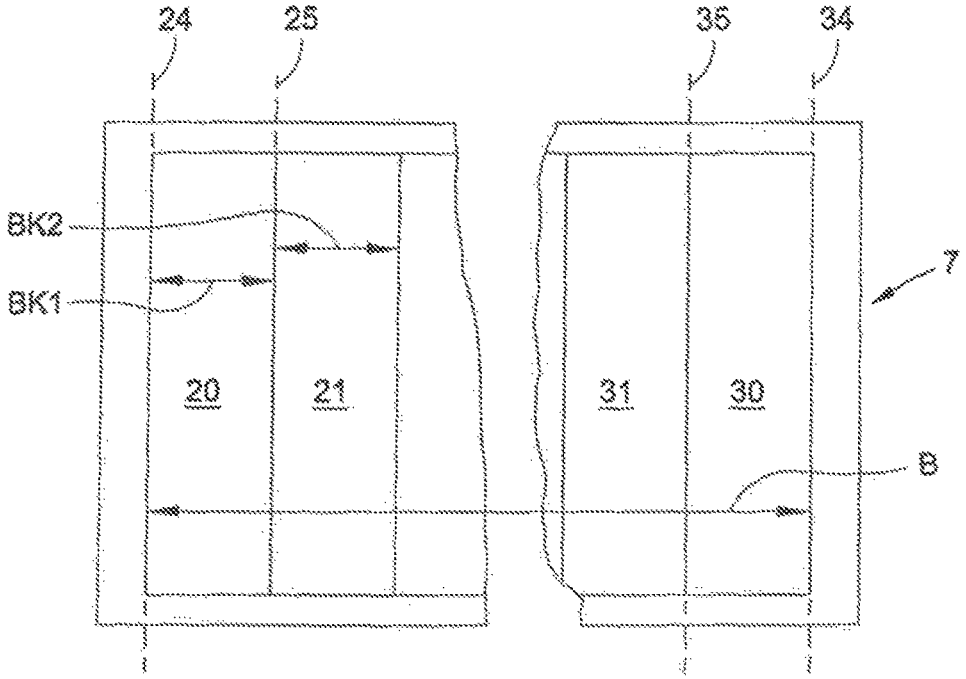
FIG. 3 shows a door of the door system.

FIG. 3 shows a car door 7, which is arranged at a car door opening, of a door system in the closed position thereof. The car door opening has a door opening width B. In an exemplary manner, the car door 7 comprises a plurality of car door leaves 20, 21, 30, 31. The car door leaves 20, 21, 30, 31, in the closed position thereof, cover the car door opening substantially completely. This means that a first one of these car door leaves 20, 21, 30, 31 covers or closes, respectively, at least a part of the car door opening.

In the closed position thereof, a first one of the car door leaves 20, which is pivotably mounted at a main pivot axis 24, has a horizontally oriented width BK1 in the direction of the door opening width B. Spaced apart from the main pivot axis 24, a second one of the car door leaves 21 can be pivotably mounted at the first car door leaf 20 at a secondary pivot axis 25, wherein the first and the second car door leaf 20, 21 form a fold of a folding door. In the closed position thereof, the second car door leaf 21 has a horizontally oriented width BK2 in the direction of the door opening width B. Preferably, the widths BK1 and BK2 of the door leaves 20, 21 are largely identical. The car door leaves 30, 31 and the pivot axes 34, 35 correspond to the car door leaves 20, 21 and pivot axes 24, 25 respectively in mirror image.

FIG. 3 and the description provided thereto also apply to a shaft door of the door system.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A door system for an elevator installation including an elevator car for travel in an elevator shaft, the door system comprising:

a pivotable first car door leaf arranged at the elevator car;

a pivotable first shaft door leaf arranged at a shaft door opening of the elevator shaft, wherein at least a part of the shaft door opening is closed by the first shaft door leaf in a closed position thereof and a shaft door plane is formed by the first shaft door leaf, wherein at least a part of a car door opening of the elevator car is closed by the first car door leaf in a closed position thereof and a car door plane is formed by the first car door leaf;

wherein the car door leaf, in an open position thereof, extends through the shaft door plane, or the shaft door leaf, in an open position thereof, extends through the car door plane;

wherein the first car door leaf is mounted at a main pivot axis arranged at the elevator car and the first shaft door leaf is mounted at a further main pivot axis, the main pivot axis being arranged in parallel to the further main pivot axis;

a second car door leaf pivotably mounted at a secondary pivot axis at the first car door leaf wherein the first car door leaf and the second car door leaf form a folding car door;

a second shaft door leaf pivotably mounted at a further secondary pivot axis at the first shaft door leaf wherein the first shaft door leaf and the second shaft door leaf form a folding shaft door, wherein the secondary pivot axes are arranged in parallel to the main pivot axes; and wherein the first shaft door leaf and the first car door leaf, in the open position, are adjacent each other, wherein the second shaft door leaf and the second cabin door leaf, in the open position, are adjacent each other, and wherein the first shaft door leaf and the second shaft door leaf are disposed between the first car door leaf and the second car door leaf in the open position or the first car door leaf and the second car door leaf are disposed between the first shaft door leaf and the second shaft door leaf in the open position.

2. The door system according to claim 1 wherein second car door leaf has a bearing shaft arranged to be displaced along the car door plane during an opening or closing of the door system and the second shaft door leaf has a further bearing shaft arranged to be displaced along the shaft door plane during the opening or closing of the door system.

3. The door system according to claim 1 wherein the first car door leaf and the second car door leaf, in the open position, form an opening angle in a range of 5-15 degrees.

4. The door system according to claim 1 wherein the first shaft door leaf and the second shaft door leaf, in the open position, form an opening angle in a range of 5-15 degrees.

5. The door system according to claim 1 wherein at least one of the main pivot axes and the secondary pivot axes are arranged vertically.

6. The door system according to claim 1 being formed as a folding door system.

7. The door system according to claim 1 wherein the first shaft door leaf, in the closed position, has a horizontally oriented width parallel to the shaft door plane, and the first car door leaf, in the closed position, has a horizontally oriented width parallel to the car door plane, wherein the widths are identical.

8. The door system according to claim 7 wherein the second shaft door leaf, in the closed position, has a horizontally oriented width parallel to the shaft door plane, and the second car door leaf, in the closed position, has a horizontally oriented width parallel to the car door plane, wherein the widths of the second shaft door leaf and the second car door leaf are substantially identical, and wherein the width of the first car door leaf is identical to the width of the second car door leaf.

* * * * *